United States Patent [19]

Muta et al.

[11] Patent Number: 4,954,056

[45] Date of Patent: Sep. 4, 1990

[54] SCROLL MACHINE WITH PIN COUPLING

[75] Inventors: Yoshifumi Muta; Kozaburo Fujii, both of Fukuoka, Japan

[73] Assignee: Mitsubishi Denki Kabushiki Kaisha, Tokyo, Japan

[21] Appl. No.: 480,345

[22] Filed: Feb. 13, 1990

Related U.S. Application Data

[62] Division of Ser. No. 281,372, Dec. 8, 1988, abandoned.

[30] Foreign Application Priority Data

Apr. 14, 1988 [JP] Japan ..... 63-93940

[51] Int. Cl.[5] ..... F01C 1/04; F16D 3/16

[52] U.S. Cl. ..... 418/55.3; 464/137

[58] Field of Search ..... 418/55 B; 464/102, 137

[56] References Cited

U.S. PATENT DOCUMENTS 732,079 6/1903 Hunt ..... 464/137

FOREIGN PATENT DOCUMENTS 980737 1/1951 France ..... 418/55 B 62-199983 9/1987 Japan ..... 418/55 B

*Primary Examiner*—John J. Vrablik

*Attorney, Agent, or Firm*—Sughrue, Mion, Zinn, Macpeak and Seas

[57] ABSTRACT

A scroll machine includes a first scroll 13 driven by a driving source, a second scroll 17 disposed eccentrically with respect to the first scroll and associated therewith to compress fluid, a plurality of first pins 22 arranged on the first scroll along a first circle coaxial with the scroll and protruding axially of the first scroll, a plurality of second pins 25 arranged on the second scroll along a second circle having the same radius as that of the first circle and protruding axially thereof and a connecting portion ring 26 for coupling the first pins to the second pins such that center positions of the first and the second scrolls are always separated from each other by an eccentricity of the second scroll with respect to the first scroll.

3 Claims, 5 Drawing Sheets

SCROLL MACHINE WITH PIN COUPLING

This is a division of Ser. No. 281,372 filed Dec. 8, 1988, now abandoned.

BACKGROUND OF THE INVENTION

The present invention relates to an improvement of a scroll machine for compressing fluid by means of a pair of associating scrolls.

U.S. Pat. No. 3,884,599 discloses an example of a conventional scroll machine which is shown in FIGS. 10 to 12 of this application. In FIGS. 10 to 12, a scroll machine includes a drive scroll 100 having a convolute scroll land 100*a* and a driven scroll 101 disposed in eccentricity with respect to the drive scroll 100 and having a convolute scroll land 101*a* associated with the land 100*a* of the drive scroll 100 to compress fluid. A coupling 102 is disposed between the drive scroll 100 and the driven scroll 101 and has a first groove 102*a* engageable slidably in an X direction with the drive scroll 100 and a second groove 102*b* engageable slidably in a Y direction with the driven scroll 101.

When the drive scroll 100 rotates, the driven scroll 101 is rotated through the coupling 102. That is, since the first groove 102*a* of the coupling 102 engages with the drive scroll 100 while the second groove 102*b* engages with the driven scroll 101, the coupling 102 transmits rotation of the drive scroll 100 to the driven scroll 101 while swinging in X and Y directions.

Thus, in the conventional scroll machine, fluid is compressed between the scrolls which are always in contact with the first and the second grooves of the coupling. Such continuous contact between the scrolls and the grooves of the coupling creates problems of heat generation and abrasion which lead a rapid degradation of sealing between the scroll lands and a vibration and noise problem due to the continuous swing motion of the coupling, resulting in a shortage of duration of the machine and a restriction of rotation speed of the machine.

SUMMARY OF THE INVENTION

An object of the present invention is to provide a scroll machine in which temperature rising and abrasion at a coupling portion coupling a drive scroll to a driven scroll are restricted to thereby realize a high speed operation of the machine.

According to a first aspect of the present invention, a scroll machine comprises a first scroll to be driven by a driving source, a second scroll disposed eccentrically with respect to the first scroll and associated therewith to compress fluid, a plurality of first pins arranged on the first scroll along a first circle coaxial with the scroll and protruding axially of the first scroll, a plurality of second pins arranged on the second scroll along a second circle having the same radius as that of the first circle and protruding axially thereof and a connecting portion for coupling the first pins to the second pins such that center positions of the first and the second scrolls are always separated from each other by an eccentricity of the second scroll with respect to the first scroll.

According to another aspect of the present invention, the connecting portion takes in the form of a cylinder having an inner diameter D and a relation, $D=\delta+R1+R2$, is established between the inner diameter of the cylinder, the eccentricity $\delta$ of the second circle with respect to the first circle and a radius R1 of the first circle and a radius of the second circle.

According to another aspect of the present invention, the connecting portion is composed of first bearings each for supporting one of the first pins, second bearings each for supporting one of the second pins and bushing each for supporting a pair of the first and the second bearings.

In the present invention, paired first and second pins are coupled by the connecting portion and the second pin is rotated by the first pin through the connecting portion. Therefore, slippage of the connecting portions of the first and the second scrolls is restricted and swing motions of the connecting portions is also restricted.

DETAILED DESCRIPTION OF THE PREFERRED EMBODIMENTS

Figure 1:
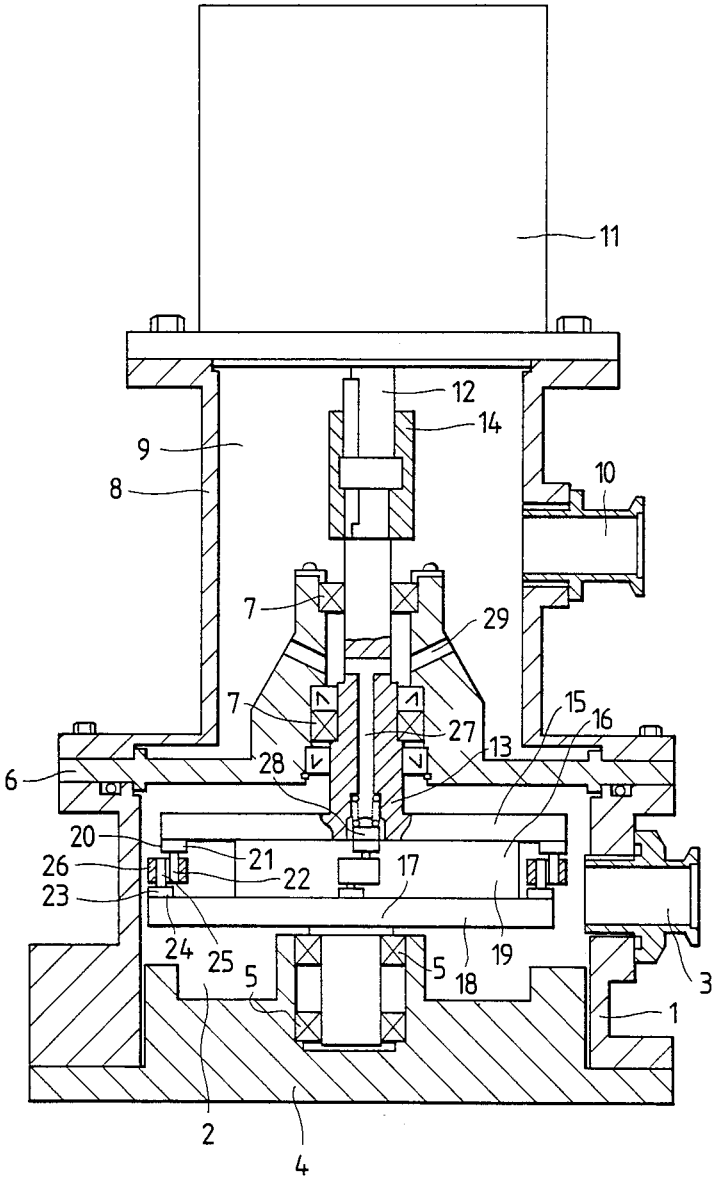
FIG. 1 is a partial cross section of an embodiment of the present invention.
Figure 2:
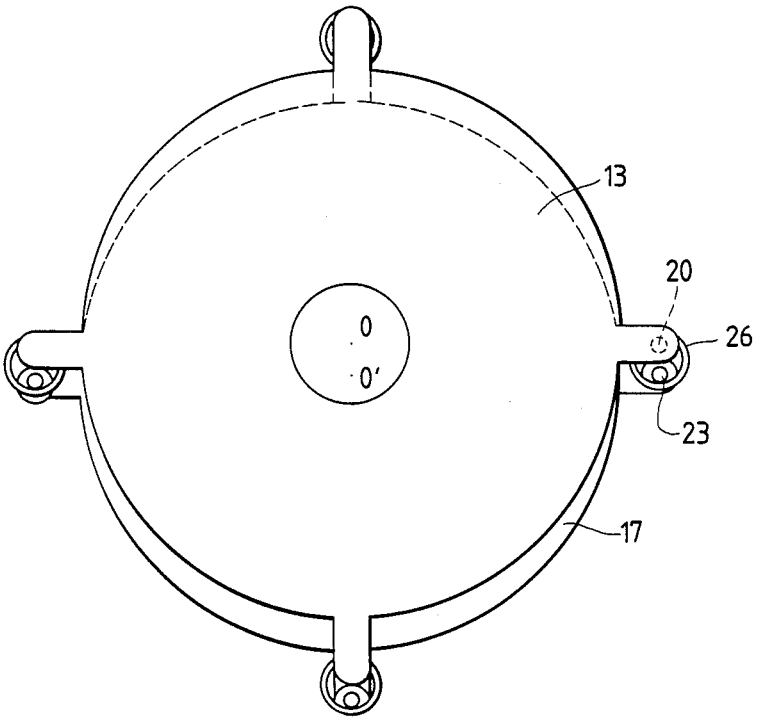
FIG. 2 is a partial plan view of the embodiment shown in FIG. 1.

In an embodiment shown in FIGS. 1 to 4, a scroll machine comprises a first container 1 having a suction chamber 2 and a suction port 3 arranged in an outer periphery thereof and a lower bearing housing 4 fixedly secured to a lower portion of the first container 1 and having a pair of bearings 5. The machine further comprises an upper bearing housing 6 fixedly secured to an upper portion of the container 1 and having bearings 7 positioned eccentrically with respect to the bearings 5. A second container 8 in the form of cylinder has an inner atmospheric chamber 9 and a discharge port 10 on a side portion thereof. A motor 11 is mounted on an upper portion of the container 8 and an output shaft 12 thereof protrudes downwardly.

A drive scroll 13 is rotatably supported by the bearings 7 and adapted to be driven by the shaft 12 of the motor 11 through a coupling 14. The drive scroll 13 has an end plate 15 and a convolute scroll land 16. A driven scroll 17 is rotatably supported by the bearings 5 and has an end plate 18 formed with a convolute scroll land 19.

Four first pins 20 are arranged equiangularly along a circle on a lower surface of the end plate 18 of the drive scroll 13 and protrude axially downwardly therefrom, each of which has a large diameter portion 21 and a small diameter portion 22 having a radius of R1. Four second pins 23 are arranged equiangularly along a circle on an upper surface of the end plate 18 of the driven scroll 17 and extend axially upwardly therefrom, each of which has a large diameter portion 24 and a small diameter portion 25 having a radius R2. A ring 26 is provided for each pair of the first and the second pins 20 and 23. The ring 26 has an inner periphery which circumscribes with the first and the second pins 20 and 23.

A radius L1 of the circle along which the first pins 20 are arranged is the same as a radius L2 of the circle along which the second pins 23 are arranged, and an inner diameter D of the ring 26 is equal to a sum of the eccentricity δ of the driven scroll 17 with respect to the drive scroll 13, a radius R1 of the first pin 20 and a radius R2 of the second pin 23.

In these figures, reference numerals 27, 28 and 29 depict a discharge port provided in the drive scroll 13, a check valve for on-off controlling the discharge port 27 and a discharge path formed in the bearing housing 6, respectively.

In operation, when the drive scroll 13 is rotated about a rotation center 01 thereof by the motor 11 through the coupling 14, the driven scroll 17 is rotated through the first pins 20, the second pins 23 and the rings 26 about a rotation center 02 thereof in synchronism with the drive scroll. With such synchronous rotations of the scrolls 13 and 17, fluid in a utilization means (not shown) is sucked up through the suction port 3 to the suction chamber 2 and compressed in the compression chamber provided between the convolute lands 16 and 19 of the scrolls 13 and 17. The check valve 28 is opened by increased fluid pressure in the compression chamber to discharge it through the discharge ports 27 and 29 to the atmospheric chamber 9 and then through the discharge port 10 to atmosphere.

Figure 3:
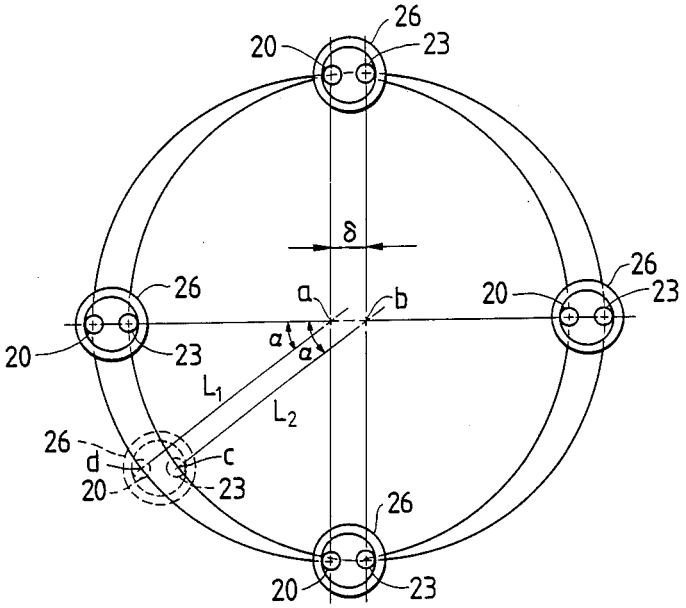
FIG. 3 shows a locus of each pin of the embodiment in FIG. 1.
Figure 4:
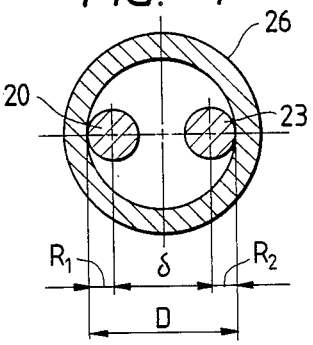
FIG. 4 is an enlarged cross section of the pins shown in FIG. 3.

Describing a transmission of rotation from the drive scroll 13 to the driven scroll 17 with reference to FIG. 3, line segments connecting from the rotation center 01 of the drive scroll 13 through the rotation center 02 of the driven scroll 17, a center of the second pin 23 and a center of the first pin 20 back to the rotation center 01 form a parallelopiped since $L1=L2$ and $D=\delta+R1+R2$. Therefore, the segment between the rotation centers 01 and 02 and the segment between the centers of the pins 20 and 23 are parallel with each other and have the same length, so that the inner periphery of the ring 26 always circumscribes with the small diameter portions of the first and the second pins 20 and 23. Thus, the driven scroll 17 is rotated in synchronism with the drive scroll 13, reliably. Further, each ring 26 rotates with respect to the associated first and second pins 20 and 23. That is, in FIG. 4, when $R1=R2$, the ring 26 slide-contacts with the small diameter portions of the first and the second pins 20 and 23, the problems of abrasion between the scrolls and heat generation thereby are restricted considerably. Since the rings 26 do not swing, vibration of the coupling portion and noise caused thereby are substantially reduced, making an increased rotation speed of the scroll machine possible.

Figure 5:
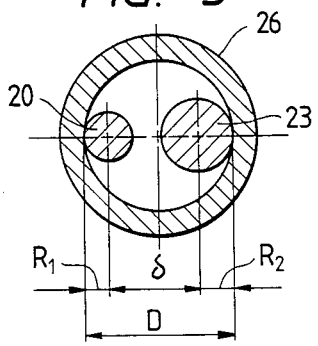
FIG. 5 is a partial, enlarged cross section of another embodiment of the present invention.

FIG. 5 shows another embodiment of the present invention, in which a radius R2 of a small diameter portion of a second pin 23 is made larger than that (R1) of a first pin 20. In this embodiment, the abrasion problem is also solved although there is a slip of a ring 26 with respect to the small diameter portion of the first pin 20, which may be negligibly small.

Figure 6:
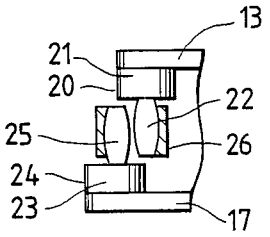
FIG. 6 is a partial side view of a further embodiment of the present invention.

FIG. 6 shows a further embodiment of the present invention, in which a first and a second pins 20 and 23 have small diameter portions 22 and 25 each having a convex center portion and the ring 26 has an inner peripheral surface concaved correspondingly. With this embodiment, vertical relative movement of the ring 26 to the pins 20 and 23 is prevented to thereby prevent abrasion of end portions of the ring with stepped portions of the pins.

Figure 7:
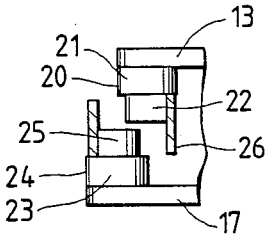
FIG. 7 is a partial side view of a still further embodiment of the present invention.

FIG. 7 shows another embodiment of the present invention, in which a relation $D<2(R1+R2)$ is established between an inner diameter D of a ring and radii R1 and R2 of a first and a second pins 20 and 23. That is, the first pin 20 partially overlaps with the second pin 23 so that it is possible to make the radii of the pins 20 and 23 larger to thereby increase mechanical strength of the pins, respectively.

Figure 8:
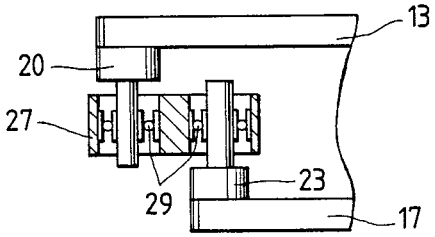
FIG. 8 is a partial side view of another embodiment of the present invention.

FIG. 8 shows a further embodiment of the present invention, in which a bushing 27 is used to couple a first pin 20 and a second pin 23. The bushing 27 has a pair of holes 28 off-centered by and supporting bearings 29 therein, respectively. The first and the second pins 20 and 23 are supported rotatably by the bearings 29, respectively. In this embodiment, abrasion between the bushing 27 and the pins 20 and 23 is completely removed.

Figure 9:
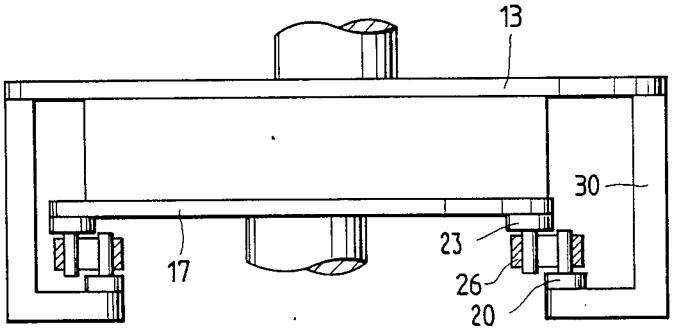
FIG. 9 is a partial side view of a further embodiment of the present invention.
Figure 10:
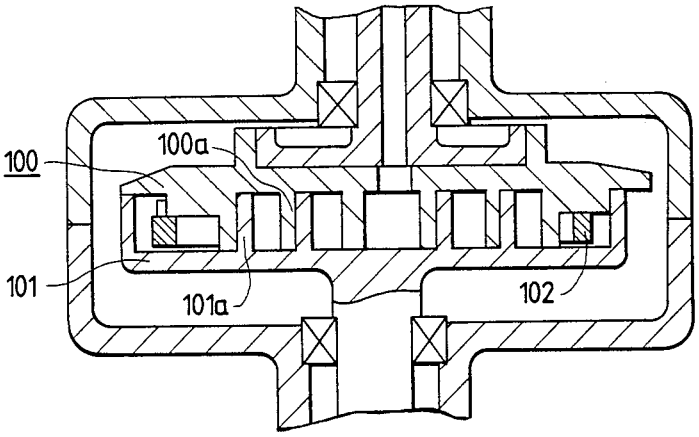
FIG. 10 PRIOR ART
FIG. 10 is a partial cross section of a conventional scroll machine.
Figure 11:
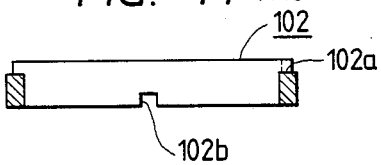
FIG. 11 PRIOR ART
FIG. 11 is a cross section of a coupling portion of the scroll machine shown in FIG. 10.
Figure 12:
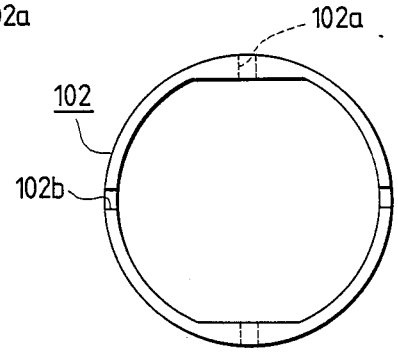
FIG. 12 PRIOR ART
FIG. 12 is a bottom view of the coupling portion shown in FIG. 11.

Although, in the embodiments mentioned hereinbefore, the first and the second pins 20 and 23 are arranged between the drive scroll 13 and the driven scroll 17, it is possible to provide the second pins on a lower surface of the driven scroll and the first pins on L-shaped arms extending downwardly from a periphery of the drive scroll. FIG. 9 shows an example of this construction. In FIG. 9, a plurality of L-shaped arms 30 are provided integrally with the drive scroll 13, on each of which an upright first pin 20 is provided. Second pins 23 are provided on a lower surface of the driven scroll 17 correspondingly to the first pins 13 and a ring 26 is arranged so that it circumscribes with a pair of the first and the second pins 20 and 23, as in the embodiments described before.

It should be noted that, although, in the described embodiments, both of the scrolls rotate, the present invention is applicable to the scroll machine having one of the scrolls being stationary.

What is claimed is:

1. A scroll machine, comprising: a first scroll (13) driven by a driving source (11), a second scroll (17) disposed eccentrically with respect to said first scroll and associated therewith to compress fluid, a plurality of first pins (22) arranged on said first scroll along a first circle coaxial with said scroll and protruding axially of said first scroll, an equal plurality of second pins (25) arranged on said second scroll along a second circle having the same radius as that of said first circle and protruding axially thereof, and an equal plurality of connecting members (26) for individually coupling associated and proximate pairs of said first pins and said second pins such that center positions of said first and said second scrolls are always separated from each other by an eccentricity of said second scroll with respect to said first scroll, wherein each of the first and second pins has a convex cylindrical configuration, and each connecting member comprises an annular ring having a concave inner surface.

2. The scroll machine claimed in claim 1, wherein each connecting member ring has an inner diameter D, and a relation, $D=\delta+R1+R2$, is established between the inner diameter of the ring, the eccentricity $\delta$ of said second circle with respect to said first circle, a radius R1 of said first pins and a radius R2 of said second pins.

3. The scroll machine claimed in claim 1, wherein radii of curvature of the convex first and second pins and the concave inner surface of the connecting member rings are equal.

* * * * *